United States Patent [19]

Soldanski et al.

[11] Patent Number: 4,834,900

[45] Date of Patent: May 30, 1989

[54] PROCESS FOR REMOVING STAINS FROM FABRICS

[75] Inventors: Heinz Soldanski, Essen; Bernd-Dieter Holdt, Duesseldorf; Petra Keup, Ratingen; Ursula Meier-Krug, Duesseldorf, all of Fed. Rep. of Germany

[73] Assignee: Henkel Kommanditgesellschaft auf Aktien, Duesseldorf, Fed. Rep. of Germany

[21] Appl. No.: 164,617

[22] Filed: Mar. 7, 1988

[30] Foreign Application Priority Data

Mar. 7, 1987 [DE] Fed. Rep. of Germany ..... 3707409

[51] Int. Cl.[4] ..... C11D 3/37; C11D 1/02; C11D 7/26; D06L 1/08

[52] U.S. Cl. ..... 252/88; 8/137; 8/142; 252/139; 252/140; 252/163; 252/168; 252/174; 252/174.17; 252/174.25

[58] Field of Search ..... 252/88, 139, 140, 174.17, 252/174.25, 174, 163, 168; 8/137, 142

[56] References Cited

U.S. PATENT DOCUMENTS

| | | | |
|---|---|---|---|
| 3,764,544 | 10/1973 | Haworth | 252/170 |
| 3,956,162 | 5/1976 | Lautenberger | 252/162 |
| 4,124,542 | 11/1978 | Devine | 252/546 |
| 4,504,407 | 3/1986 | Klutz | 252/162 |
| 4,648,882 | 3/1987 | Osberghaus et al. | 8/142 |
| 4,659,494 | 4/1987 | Soldanski | 252/88 |
| 4,678,595 | 7/1987 | Malik | 252/174.17 |

FOREIGN PATENT DOCUMENTS 3225190 1/1984 Fed. Rep. of Germany .

*Primary Examiner*—A. Lionel Clingman
*Attorney, Agent, or Firm*—Ernest G. Szoke; Wayne C. Jaeschke; Real J. Grandmaison

[57] ABSTRACT

A process for the removal of stains from fabrics, such as carpets. The process comprises treating the stained areas of the fabrics with a liquid, paste-form or foam-form stain remover and subjecting the entire fabric to cleaning with a powder-form cleaning composition before the treated areas have dried. The preferred stain remover is an aqueous composition containing a surfactant, and the preferred powder-form cleaning composition contains a finely divided cellulose powder as an adsorbent. The new process is suitable above all for the cleaning of carpets and carpeted floors.

15 Claims, No Drawings

PROCESS FOR REMOVING STAINS FROM FABRICS

BACKGROUND OF THE INVENTION

This invention relates to a multistage process for the removal of stains from fabrics, more especially from fabrics such as carpets and carpeted floors.

In addition to shampoos, powder-form cleaning compositions have recently been used to an increasing extent for the cleaning in place of carpets and other fabric coverings. The powder-form compositions have the advantage of leaving behind no rings and of drying more quickly. The principal constituents of such cleaning powders are surfactants and absorbents, and also relatively large quantities of water in loosely bound form. The surfactants in combination with the water are assumed to be responsible for the detachment of the soil particles from the fibers and for their transport to the absorbent which, after the water has dried, is removed together with the soil either by brushing or by vacuum cleaning. Examples of such powder-form cleaning compositions can be found in Austrian Patent specification 296,477, in U.S. Pat. No. 4,648,882 and in U.S. Pat. No. 4,659,494. These known compositions achieve a high standard in regard to cleaning large carpet areas and convenient handling. However, a problem with powder-form fabric cleaning compositions is that stains on the fabrics are often not fully removed during the surface cleaning process and remain visible, even after the cleaning composition has been removed by brushing or by vacuum cleaning. Hitherto, it has not been possible to satisfactorily overcome this disadvantage even by prespotting with the powder-form cleaning compositions.

On the other hand, there are many known compositions specifically formulated for the removal of stains from fabrics which are applied in liquid or paste-like form for the local treatment of the stained areas. These known compositions can vary widely in composition from pure solvent mixtures to purely aqueous surfactant solutions. Examples of compositions such as these can be found in German Offenlegungsschrift 32 25 190 and in U.S. Pat. Nos. 3,764,544 and 4,124,542. The disadvantage of these compositions is that, in many cases, they only act on certain types of stain or, in the case of broad-spectrum formulations, promote intensified resoiling of the treated areas. In the case of colored stains, enlargement of the stained area and subsequent rim formation often occur as well. Particularly troublesome is the formation of rings which, in many cases, is in evidence even when the original stain has been completely removed. Like the remaining stains, rings and rims are difficult or impossible to subsequently remove with powder-form fabric cleaning compositions.

Accordingly, an object of the present invention is to provide an improved stain removal process.

A further object of the invention is to provide an improved stain cleaning process for carpets and other fabrics which avoids the formation of rims or rings around stained areas after completion of the cleaning process.

Yet another object is the provision of a unitary package of separately packaged stain removal and powder compositions formulated for separate application to surfaces to be cleaned.

These and other objects of the invention will become evident from the following description.

SUMMARY OF THE INVENTION

The present invention relates to a process for the removal of stains from fabrics, more especially from carpets and carpeted floors, in which the stain is first treated with a liquid, paste-like or foam-like stain remover after which the entire fabric is treated with a powder-form cleaning composition before the stain remover has dried. In one particular embodiment of this process, the powder-form cleaning composition is locally applied for prespotting before cleaning the whole fabric after the liquid, paste-like or foam-like stain remover has been applied.

The new process is distinguished above all by the fact that no obstinate rings or rims are formed around the original stains and also by the fact that there is hardly any intensified resoiling in the originally stained area. It is thus possible to satisfactorily clean even stained fabrics, particularly carpets, over their entire surface with the easy-to-handle powder-form cleaning compositions.

DETAILED DESCRIPTION OF THE INVENTION

In the first step of the process according to the invention, the stain remover, which is present as a liquid or paste or as a readily collapsing foam dispensed from an aerosol can, is applied to the stain and rubbed into the stain, for example using a cloth, a brush or a sponge which may optionally be moistened. The quantity of the stain remover applied depends upon the nature and size of the stains and by the nature of the stain remover. The stain remover is normally applied in quantities of from 5 to 20 g/dm$^2$ (grams per square decimeter) of the fabric, although in individual cases, for example in the case of thin fabrics and readily spreadable formulations, it may also be applied in distinctly smaller quantities down to about 1 g/dm$^2$ or, in the case of deep-pile carpets and less readily spreading formulations, even in larger quantities of up to about 30 g/dm$^2$. Even relatively large stains, for example runner marks on carpeted floors, may require only small quantities, for example, 20 to 100 g/m$^2$ (grams per square meter) of stain remover. The intensity of the mechanical treatment of the stain in conjunction with application of the stain remover also depends largely upon the nature and age of the stain and upon the effectiveness of the stain remover. In the case of light stains, the mechanical treatment may be eliminated altogether. In no case, however, should the first step of the stain removal process be continued for so long that the stain removers dry on the fabric before the next step of the overall process is commenced.

In the most simple embodiment, the second step of the process according to the invention comprises applying the powder-form cleaning composition to the entire surface of the fabric in the usual way. To this end, the powder is uniformly scattered over the surface of the fabric, worked into the fabric with suitable implements, for example a sponge or brush, and removed from the fabric again by beating, brushing or by vacuum cleaning after a period of drying which is largely determined by the nature of the cleaning formulation. The quantity in which the cleaning composition is applied depends largely on its quality, on the weight of the fabrics and on their degree of soiling. The cleaning composition is normally applied in quantities of from 20 to 200 g/m$^2$, although in individual cases it may be applied in much larger quantities of up to about 1000 g/m$^2$, particularly in the originally stained areas. The working-in time is also dependent on the factors mentioned above and is generally between 0.5 and 2.5 minutes per m$^2$. After rubbing in, the fabrics are left to dry until the cleaning compositions have changed into dry residues. Depending on temperature and air humidity, drying times range from a few minutes to several hours. The residues are then mechanically removed from the fabrics, for example by brushing or by vacuum cleaning. The powder-form cleaning composition may be applied largely manually, for example in the home, although it is also possible to carry out distribution, rubbing in and further steps by means of suitable machines, for example combined scattering and brushing machines. Hence the process may be used in the institutional sector.

In one preferred embodiment, the powder-form cleaning composition, before being applied over the entire surface, is first applied and worked into only the originally stained areas before the stain remover has dried. The quantity in which the powder-form cleaning composition is used in this preliminary treatment is generally larger than the quantity in which it is used in the subsequent surface cleaning treatment, generally amounting to between about 5 and about 70 g/dm$^2$. The cleaning composition may be worked in by means of a sponge or a brush either manually or using suitable machines. The working-in time is determined by the weight of the fabric and is of the order of about 10 seconds to about 1 minute/dm$^2$. This intensive, local incorporation of the powder-form cleaning composition is followed by the above-described surface cleaning of the entire fabric with this composition.

The outstanding effectiveness of the process according to the invention is assumed to be attributable inter alia to the fact that the liquids and active substances present in the stain remover convert the constituents of the stain into a mobile form in which they are then taken up by and removed with the solid constituents of the powder-form cleaning composition.

Aqueous stain removers and also stain removers based on organic solvents may be used for the first step of the process according to the invention. The stain removers are applied in the form of a liquid, paste or foam and are intended to contain at least 70% by weight and preferably at least 80% by weight volatile constituents. Examples of stain removers such as these can be found in the relevant literature.

Most solvent-based stain removers, also known as spot removers, are water-free and generally contain no surfactants. The solvents used are predominantly alcohols, gasolines, chlorinated hydrocarbons, butyl acetate and similar, readily volatile compounds either individually or in admixture. Stain removers of this type are particularly suitable for the removal of fatty stains and stains left by felt-tip and ball-point pens.

Paste-form stain removers consist of a mixture of very finely divided adsorbents, such as silica or starch, and organic solvents, particularly gasoline and chlorinated hydrocarbons. Stain removers of this type are also particularly suitable for the removal of fatty stains and ball-point stains.

Aqueous stain removers contain surfactants in quantities of from about 0.4 to 10% by weight and, in most cases, readily water-soluble solvents, such as lower alcohols, salts, such as phosphates and borax, and other active cleaning substances. Stain removers of this type are useful not only for individual types of stains, but in many cases for removal of universal stains. They may be directly applied in liquid form or in foam form for easier spreadability.

Aqueous formulations are particularly suitable for the process according to the invention. One preferred stain remover of this type has the following composition:

| | |
|---|---|
| surfactants | 1 to 8% by weight |
| polymeric additives | 0 to 0.1% by weight |
| solvents | 0 to 30% by weight |
| standard additives | 0 to 5% by weight |
| water | balance to make 100% |

Surfactants suitable for this stain remover include anionic and nonionic surfactants. Alkyl sulfates, alkyl sarcosides and alkyl sulfosuccinates containing long-chain alkyl radicals ($C_8$–$C_{18}$) are preferably used as anionic surfactants. Other suitable anionic surfactants include $C_{12}$–$C_{18}$ alkane sulfonates, monoalkyl polyethylene glycol ether sulfates containing 10 to 20 carbon atoms in the alkyl moiety and 1 to 6 ethylene glycol units in the molecule and also soaps, salts of fatty acid cyanamides or salts of long-chain ether carboxylic acids. The anionic surfactants are preferably used in the form of the sodium salts.

Suitable nonionic surfactants include the adducts of 1 to 30 moles and preferably 4 to 15 moles ethylene oxide with 1 mole of a long-chain $C_{10}$–$C_{20}$ compound selected from the group consisting of alcohols, alkylphenols, carboxylic acids and carboxylic acid amides. Preferred nonionic surfactants are the adducts of ethylene oxide with long-chain, primary or secondary alcohols, such as for example fatty alcohols or oxoalcohols containing 10 to 20 carbon atoms, and with mono or dialkylphenols containing 6 to 14 carbon atoms in the alkyl groups.

Although it is possible to use as the surfactant component surfactants which lead to tacky residues by virtue of the aftertreatment with the powder-form cleaning compositions, it is preferred to use anionic surfactants which, on their own, leave powder-form residues. Preferred anionic surfactants include sodium alkyl sulfates, sodium alkyl sarcosides and sodium alkyl sulfosuccinates, of which sodium alkyl sulfates containing 12 to 16 carbon atoms, more especially technical grade sodium lauryl sulfate, are particularly preferred.

The stain-removing effect of the surfactants may be further improved by the addition of certain water-soluble polymers. Such polymers may be added in small quantities of up to about 0.1% by weight and are preferably compounds of the following types: polyethylene oxides having molecular weights of 200,000 to 5,000,000, nonionic cellulose ethers, such as methyl cellulose and hydroxyethyl cellulose, polyvinyl alcohol, polyacrylamide and homopolymers of acrylic acid, methacrylic acid and maleic acid and copolymers of these compounds with suitable comonomers. The quantity in which the polymers are used is determined by the chemical composition of the polymer and may extend to a lower limit of approximately 0.001% by weight, based on the stain remover as a whole. For example, the polyethylene oxides mentioned are preferably used in quantities of from 0.001 to 0.01% by weight while the other polymers are preferably used in quantities of from 0.01 to 0.05% by weight, based on the stain remover as a whole.

Although effective stain removal is obtained even without the use of organic solvents, not the least by virtue of the cleaning-enhancing effect of the polymers, the preparations may contain up to 30% by weight of organic solvents to enhance the cleaning effect, particularly with respect to fatty stains and stains left by ball-point pens or felt-tip pens. Suitable organic solvents are both water-immiscible and water-miscible organic solvents showing limited solubility in water, for example $C_3$–$C_5$ alcohols, acetone, glycol ethers containing up to 10 carbon atoms, gasolines boiling in the range from 100 to 280° C. and also terpenes in relatively small quantities. Particularly preferred organic solvents are $C_2$ and $C_3$ alcohols and $C_4$–$C_7$ glycol ethers, more especially ethanol, isopropanol, dipropylene glycol monomethyl ether and propylene glycol monoisobutyl ether. The overall solvent content is preferably between 5 and 25% by weight, based on the stain remover as a whole.

The stain removers may also contain standard additives, such as salts, preservatives, perfume, thickeners and insoluble polymers having minimum film-forming temperatures above 70° C., for example polymethyl methacrylate. The quantity in which these additives are present is normally not more than 5% by weight and preferably between 0.01 and 2% by weight.

One particularly preferred stain remover has the following composition:

1 to 5% by weight of an anionic surfactant from the group consisting of sodium alkyl sulfates, sodium alkyl sarcosides and sodium alkyl sulfosuccinates and mixtures thereof;

0.001 to 0.05% by weight of a water-soluble polymer from the group consisting of polyethylene oxides having molecular weights of from 200,000 to 5,000,000, nonionic cellulose ethers, polyvinyl alcohol, polyacrylamide, homopolymers and copolymers of acrylic acid, methacrylic acid and maleic acid, and mixtures thereof;

5 to 25% by weight of an organic solvent from the group consisting of $C_2$–$C_3$ alcohols, $C_4$–$C_7$ glycol ethers and mixtures thereof;

0.01 to 2% by weight of additives from the group consisting of salts, preservatives, perfume, thickeners and insoluble polymers having minimum film forming temperatures above 70° C.; and water to make 100%.

The powder-form cleaning compositions used in the process according to the invention may be based on various adsorbents, for example diatomaceous earth, talcum, sawdust, bleached wood powder, starch or finely divided silica. Cleaning compositions such as these generally contain from 20 to 80% by weight of adsorbents, up to 10% by weight and more of surfactants and also organic solvents, water or combinations of both. Particular significance is attributed to compositions based on wood powder, starch and starch derivatives and especially to compositions containing powdered synthetic resin foam, zeolite or cellulose powder as adsorbents. Compositions such as these are described in Austrian Patent specification 296,477, in U.S. Pat. No. 4,648,882 and in U.S. Pat. No. 4,659,494, the disclosures of which patents are incorporated herein by reference. The compositions based on cellulose powder described in U.S. Pat. No. 4,659,494 are particularly preferred cleaning formulations.

Powder-form cleaning compositions based on synthetic resin foam powders consist essentially of 20 to 40 parts by weight of a powdered foam plastic having a particle size of 0.1 to 3 mm and of 80 to 60 parts by weight of an aqueous solution in turn containing 10 to 50% by weight of organic solvents and 0.1 to 4% by weight of anionic or nonionic surfactants. Suitable plastics are powders of foamed polystyrene, polyurethane, phenol-formaldehyde resin, and preferably urea-formaldehyde resin.

The powder-form cleaning compositions based on zeolite contain the adsorbent in quantities of from 15 to 90% by weight, preferably in an agglomerated form. In addition to zeolite, the compositions normally contain from 5 to 50% by weight of organic solvents, from 1 to 40% by weight of agglomerating aids and from 0.1 to 15% by weight of anionic or nonionic surfactants.

The cleaning compositions based on cellulose powder which are particularly preferred for the purposes of the invention combine high cleaning power with minimal residue formation on the fabrics, so that dark-colored fabrics do not turn grey. These cleaning compositions are characterized by a content of cellulose powder having a particle size of 1 to 150 um and more especially of 5 to 50 um which is preferably produced by mechanical size-reduction of cellulose obtained from wood, particularly beechwood cellulose.

In a preferred embodiment, these compositions contain:

35 to 70% by weight cellulose powder,
25 to 60% by weight water,
5 to 22% by weight organic solvent,
0 to 4% by weight anionic or nonionic surfactant, and
0 to 5% by weight other standard additives.

Preferred organic solvents used in these compositions are $C_2$–$C_3$ alcohols, propylene glycol ethers boiling at 120° to 250° C., gasolines boiling at 130° to 200° C. and also mixtures of these solvents.

These cleaning compositions may contain both nonionic and anionic surfactants or mixtures thereof, although anionic surfactants are preferred.

Suitable nonionic surfactants include the adducts of 1 to 30 moles and preferably 4 to 15 moles ethylene oxide with 1 mole of a long-chain $C_{10}$–$C_{20}$ compound from the group consisting of alcohols, alkylphenols, carboxylic acids and carboxylic acid amides. Preferred nonionic surfactants are the adducts of ethylene oxide with long-chain, primary or secondary alcohols, such as for example fatty alcohols or oxo alcohols containing 10 to 20 carbon atoms, and with mono- or dialkylphenols containing 6 to 14 carbon atoms in the alkyl groups.

Suitable anionic surfactants include, in particular, those of the sulfate or sulfonate type, although it is also possible to use other types, such as soaps, long-chain N-acyl sarcosinates, salts of fatty acid cyanamides or salts of ether carboxylic acids of the type obtainable from long-chain alkyl or alkylphenyl polyglycol ethers and chloroacetic acid. The anionic surfactants are preferably used in the form of the sodium salts.

Particularly suitable surfactants of the sulfate type are the sulfuric acid monoesters of long-chain, primary $C_{10}$–$C_{20}$ alcohols of natural and synthetic origin, i.e., of fatty alcohols such as, for example, coconut fatty alcohols, tallow fatty alcohols, oleyl alcohol, or the $C_{10}$–$C_{20}$ oxo alcohols and those of secondary alcohols having the same chain lengths. The sulfuric acid monoesters of aliphatic primary alcohols, secondary alcohols or alkylphenols ethoxylated with 1 to 6 moles ethylene oxide may also be used. Sulfated fatty acid alkanolamides and sulfated fatty acid monoglycerides are also suitable.

Suitable surfactants of the sulfonate type are, primarily, sulfosuccinic acid mono- and diesters containing 6 to 22 carbon atoms in the alcohol parts, alkylbenzene sulfonates containing $C_9$–$C_{15}$ alkyl groups and the esters of α-sulfofatty acids, for example the α-sulfonated methyl or ethyl esters of hydrogenated coconut, palm kernel or tallow fatty acids. Other suitable surfactants of the sulfonate type are the alkane sulfonates obtainable from $C_{12}$–$C_{18}$ alkanes by sulfochlorination or sulfoxidation and subsequent hydrolysis or neutralization or by bisulfite addition to olefins and also olefin sulfonates, i.e., mixtures of alkene and hydroxyalkane sulfonates, and disulfonates of the type obtained, for example, from long-chain monoolefins containing a terminal or internal double bond by sulfonation with gaseous sulfur trioxide and subsequent alkaline or acidic hydrolysis of the sulfonation products.

It is particularly preferred to use $C_{12}$–$C_{18}$ fatty alcohol sulfates, salts of sulfosuccinic acid monoesters containing 16 to 20 carbon atoms in the alcohol part and mixtures of these surfactants.

In addition to the constituents already mentioned, the cleaning compositions may contain small quantities of other auxiliaries and additives of the type typically used in fabric and carpet cleaning compositions. Examples of auxiliaries and additives such as these include antistatic components, optical brighteners, resoiling inhibitors, scattering and spreading promoters, preservatives and perfume.

Because, in its broadest embodiment, the process according to the invention is not confined in its practical application to specific stain removers or powder-form cleaning compositions, the user of the process is able to choose largely freely between the available compositions. However, it has been found to be useful to make the compositions required for the process available to the user in the form of a combination containing both the stain remover and the powder-form cleaning compositions packed individually. In the most simple case, the combination may be characterized as a unitary package in that both containers are packed together or are attached to one another by a holder. However, another combination may be prepared by identifying both components as belonging together solely by external packaging indicia. The presentation of both components in the form of a combination has the advantage that the choice of components interacting particularly effectively with one another can be designated in this way. The user is then presented with maximum cleaning power without having to conduct preliminary tests before making a choice.

A universally suitable combination for the process according to the invention consists of the following stain remover and the powder-form cleaning composition as disclosed in U.S. Pat. No. 4,659,494;

Stain Remover:

1 to 8% by weight anionic or nonionic surfactant
0 to 0.1% by weight of water-soluble polymer
0 to 30% by weight organic solvent
0 to 5% by weight standard additives
balance to make 100% by weight water Powder-form cleaning preparation according to U.S. Pat. No. 4,659,494

35 to 70% by weight of cellulose powder having a particle size of 1 to 150 micrometers
25 to 60% by weight of water
5 to 22% by weight of organic solvent
0 to 4% by weight of anionic and/or nonionic surfactant
0 to 5% by weight other standard auxiliaries and additives The following combination of a stain remover and a dry cleaning composition according to U.S. Pat. No. 4,659,494 has proved to be particularly effective:

Stain Remover:

1 to 5% by weight of an anionic surfactant from the group consisting of sodium alkyl sulfates, sodium alkyl sarcosides, sodium alkyl sulfosuccinates and mixtures thereof,
0.001 to 0.05% by weight of a water-soluble polymer from the group consisting of polyethylene oxides having molecular weights of 200,000 to 5,000,000, nonionic cellulose ethers, polyvinyl alcohol, polyacrylamide, homopolymers and copolymers of acrylic acid, methacrylic acid and maleic acid, and mixtures thereof,
5 to 25% by weight of an organic solvent from the group consisting of $C_2$–$C_3$ alcohols, $C_4$–$C_7$ glycol ethers and mixtures thereof,
0.01 to 2% by weight of standard additives from the group consisting of salts, preservatives, perfume, thickeners and insoluble polymers having minimum film forming temperatures above 70° C., and
water to make 100%.

Powder-form cleaning composition according to U.S. Pat. No. 4,659,494:

45 to 55% by weight of hardwood cellulose powder having a particle size of 5 to 50 um,
30 to 40% by weight of water
10 to 15% by weight of an organic solvent from the group consisting of $C_2$–$C_3$ alcohols, propylene gylcol ethers, gasolines and mixtures thereof,
0.05 to 1% by weight of an anionic surfactant from the group consisting of $C_{12}$–$C_{18}$ fatty alcohol sulfates, monoalkyl sulfosuccinates containing 16 to 22 carbon atoms in the alcohol part and mixtures thereof and
0 to 2% by weight of other standard auxiliaries and additives.

The following Examples are illustrative of the invention.

EXAMPLE 1

A particularly suitable stain remover for the process according to the invention has the following composition:

| | |
|---|---|
| sodium lauryl sulfate (technical, 85%) | 1.5% by weight |
| polyethylene glycol (MW 600,000) | 0.002% by weight |
| isothiazolone derivatives (preservative) | 0.013% by weight |
| perfume | 0.2% by weight |
| water | 98.285% by weight |

EXAMPLE 2

A stain remover particularly effective against ball-point and felt-tip pen stains has the following composition:

| | |
|---|---|
| sodium lauryl sulfate | 4.5% by weight |

-continued

| | |
|---|---|
| (technical, 85%) | |
| isothioazolone derivatives (preservative) | 0.013% by weight |
| dipropylene glycol methyl ether | 6.20% by weight |
| propylene glycol isobutyl ether | 1.30% by weight |
| isopropanol | 7.50% by weight |
| perfume | 0.20% by weight |
| water | 80.287% by weight |

EXAMPLE 3

A powder-form cleaning composition is of the following composition:

| | |
|---|---|
| cellulose powder (5–50 μm) | 52.0% by weight |
| sodium lauryl sulfate | 1.5% by weight |
| isopropanol | 5.0% by weight |
| synthetic isoparaffin (boiling range 155–173° C.) | 5.0% by weight |
| perfume | 0.25% by weight |
| preservative (isothiazolone derivative) | 0.013% by weight |
| water | 36.237% by weight |

EXAMPLE 4

Cleaning combination:

A combination intended for co-application consisted of 50 ml of a stain remover and 750 g of a powder-form cleaning composition. The stain remover packed in a plastic bottle and the cleaning powder packed in a sealed polyethylene bag were packed together in a box which was printed inter alia with instructions for use. The compositions of the two components of the combination were as follows:

| | |
|---|---|
| Stain remover: | |
| sodium lauryl sulfate, 90% | 1.700% by weight |
| Na lauryl sarcoside, 30% | 0.600% by weight |
| hydroxymethyl cellulose | 0.002% by weight |
| isothiazolone derivatives | 0.013% by weight |
| perfume | 0.200% by weight |
| water | 97.485% by weight |
| Powder-form cleaning composition: | |
| cellulose powder (5–50 μm) | 48.000% by weight |
| fatty alcohol + 10 EO | 1.500% by weight |
| isopropanol | 6.000% by weight |
| dipropylene glycol monoethyl ether | 5.000% by weight |
| isothiazolone derivatives | 0.013% by weight |
| perfume | 0.100% by weight |
| water | 39.387% by weight |

EXAMPLE 5

Cleaning process:

A beige-colored, velvet-pile polyamide carpet was provided with stains of various kinds (red wine, ketchup, cocoa, ball-point and margarine) and was subjected to the cleaning process after the stains had aged for 2 days at room temperature. To this end, the stains which measured approximately 5 cm in diameter were first wetted with 3 ml of the cleaning liquid of Example 4 and treated with a brush for about 10 seconds. 10 g of the carpet cleaning powder of Example 4 was then scattered in several portions onto the treated stains and worked in with a brush for about 30 seconds. Immediately after these prespotting steps, the surface cleaning process was commenced, approximately 120 g of the same cleaning powder per square meter being worked in by means of a motorized brush. The carpet was brushed for a duration approximately 40 to 60 seconds per square meter. After a drying time of 2 hours, most of the residues were removed with a vacuum cleaning brush. After 8 hours, the originally stained areas were again vacuum-cleaned. On completion of the cleaning process, the carpet was satisfactorily clean and showed no traces of the stains.

EXAMPLE 6

An almost equally favorable cleaning result was obtained by eliminating the second prespotting treatment of Example 5, but instead applying approximately four times the quantity of powder applied to the non-stained area onto the stained area during surface cleaning and by lengthening the working-in time (motorized brush) at those stained places.

It is to be understood that the above described embodiments of the invention are illustrative only and that modifications throughout may occur to those skilled in the art. Accordingly, this invention is not to be regarded as limited to the embodiments disclosed herein, but is to be limited as defined by the appended claims.

We claim:

1. A process for the removal of stains from fabrics in which the stain is first treated with a liquid, paste-form or foam-form stain remover composition, after which the entire fabric is treated with a powder-form cleaning composition before the stain remover composition has dried.

2. The process of claim 1 wherein additional quantities of the powder-form cleaning composition are applied to stained areas of the fabric subsequent to treatment with the stain removal composition but prior to treatment of the entire surface of the fabric with the powder-form cleaning composition.

3. The process of claim 1 wherein from about 0.2 to about 30 g of the stain remover is applied per square decimeter of fabric and from about 20 to about 200 g of the powder-form cleaning composition is applied per square meter of fabric for surface cleaning.

4. The process of claim 2 wherein the additional quantities of powder-form cleaning composition applied range from about 5 to about 50 g per square decimeter of fabric.

5. The process of claim 1 wherein the stain removal composition is an organic solvent.

6. The process of claim 1 wherein the stain removal composition is a paste comprising a mixture of an organic solvent and finely divided adsorbent.

7. The process of claim 1 wherein the stain removal composition is an aqueous composition containing a surfactant.

8. The process of claim 7 wherein the stain remover has the following composition:

about 8% by weight of a surfactant from the group consisting of anionic surfactants, nonionic surfactants and mixtures thereof, about 0 to 0.1% by weight of a water-soluble polymer, about 0 to 30% by weight of an organic solvent, about 0 to 5% by weight of other stain removal composition additives; and water to make 100%.

9. The process of claim 8 wherein the surfactants of the stain remover composition are selected from the group consiting of sodium alkyl sulfates, sodium alkyl sarcosides and sodium alkyl sulfosuccinates.

10. The process of claim 8 wherein the water-soluble polymer of the stain remover composition is selected from the group consisting of polyetylene oxides having molecular weights of from 200,000 to 5,000,000, nonionic cellulose ethers, polyvinyl alcohol, polyacrylamide, homopolymers and copolymers of acrylic acid, methacrylic acid and maleic acid, and mixtures thereof, and is present at a level of at least about 0.001% by weight.

11. The process of claim 1 wherein the powder-form cleaning composition contains cellulose powder as adsorbent.

12. The process of claim 11 wherein the cleaning preparation has the following composition:

about 35 to 70% by weight of cellulose powder having a particle size of 1 to 150 micrometers,
about 25 to 60% by weight of water,
about 5 to 22% by weight of an organic solvent,
about 0 to 4% by weight of a surfactant from the group consisting of anionic surfactants, nonionic surfactants and mixtures thereof, and
about 0 to 5% by weight of other dry cleaning composition additives.

13. A process for removal of stains from fabrics comprising:

(a) rubbing the stained area of the fabric with an aqueous stain remover composition containing an effective amount of a surfactant, said stain remover composition being applied at a level of about 0.2 to about 30 grams per square decimeter of stained surface;
(b) applying to the surface of the fabric a powder-form cleaning composition having the following composition:

about 35 to 70% by weight of cellulose powder having a particle size of 1 to 150 micrometers,
about 25 to 60% by weight of water,
about 5 to 22% by weight of an organic solvent,
about 0 to 4% by weight of a surfactant from the group consisting of anionic surfactants, nonionic surfactants and mixtures thereof, and
about 0 to 5% by weight of other dry cleaning composition additives, said powder-form cleaning composition being applied at a level of about 20 to about 200 grams per square meter of fabric surface;

(c) brushing the composition of step (b) into the fabric for a period of time ranging from about 0.5 to about 2.5 minutes per square meter of fabric surface;
(d) permitting the fabric to dry; and
(e) mechanically removing the composition from the fabric, said process further characterized in that steps (b) and (c) are carried out prior to the drying of said stain remover composition.

14. The process of claim 13 further including the step of brushing in the powder-form cleaning composition described in step (b) into the stained area of the fabric at a level of about 5 to about 70 grams per square decimeter of stained fabric surface, said brushing occuring after step (a) and prior to step (b).

15. A unitary package combination for carrying out the process of claim 1 and containing a stain remover composition and a powder-form cleaning composition in separate containers, said stain remover composition comprising:

about 1 to 8% by weight of a surfactant from the group consisting of anionic surfactants, nonionic surfactants and mixtures thereof,
about 0 to 0.1% by weight of a water-soluble polymer,
about 0 to 30% by weight of an organic solvent,
about 0 to 5% by weight of other stain removal composition additives, and
water to make 100%, and said powder-form cleaning composition comprising:

about 35 to 70% by weight of cellulose powder having a particle size of 1 to 150 micrometers,
about 25 to 60% by weight of water,
about 5 to 22% by weight of an organic solvent,
about 0 to 4% by weight of a surfactant from the group consisting of anionic surfactants, nonionic surfactants and mixtures thereof, and
about 0 to 5% by weight of other dry cleaning composition additives.

* * * * *

UNITED STATES PATENT AND TRADEMARK OFFICE

CERTIFICATE OF CORRECTION

PATENT NO. : 4,834,900

DATED : May 30, 1989

INVENTOR(S) : Soldanski et al.

It is certified that error appears in the above-identified patent and that said Letters Patent is hereby corrected as shown below:

In Claim 8, at Col. 10, line 60, after "about" add --1 to--.

Signed and Sealed this

Twentieth Day of March, 1990

*Attest:*

JEFFREY M. SAMUELS

*Attesting Officer*

*Acting Commissioner of Patents and Trademarks*